US006441558B1

(12) United States Patent
Muthu et al.

(10) Patent No.: US 6,441,558 B1
(45) Date of Patent: Aug. 27, 2002

(54) WHITE LED LUMINARY LIGHT CONTROL SYSTEM

(75) Inventors: Subramanian Muthu, Tarrytown; Chin Chang, Yorktown Heights; Gert Bruning, Sleepy Hollow, all of NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/732,197

(22) Filed: Dec. 7, 2000

(51) Int. Cl.[7] ..... H05B 37/02
(52) U.S. Cl. ..... 315/149; 315/291; 315/118
(58) Field of Search ..... 315/149–159, 315/112–120, 291, 224, 307, 308

(56) References Cited

U.S. PATENT DOCUMENTS

| | | | | |
|---|---|---|---|---|
| 3,705,316 A | | 12/1972 | Burrous et al. | 307/311 |
| 5,335,239 A | | 8/1994 | Herczeg et al. | 372/38 |
| 5,406,172 A | * | 4/1995 | Bennett | 315/116 |
| 5,783,909 A | | 7/1998 | Hochstein | 315/159 |
| 6,127,783 A | * | 10/2000 | Pashley et al. | 315/149 |

OTHER PUBLICATIONS

Specification for "LED Luminaire with Electronically Adjusted Color Balance" U. S. Ser. No. 09/216,262.

* cited by examiner

*Primary Examiner*—Don Wong
*Assistant Examiner*—Wilson Lee

(57) ABSTRACT

An LED luminary system for providing power to LED light sources to generate a desired light color comprises a power supply stage configured to provide a DC current signal. A light mixing circuit is coupled to said power supply stage and includes a plurality of LED light sources with red, green and blue colors to produce various desired lights with desired color temperatures. A controller system is coupled to the power supply stage and is configured to provide control signals to the power supply stage so as to maintain the DC current signal at a desired level for maintaining the desired light output. The controller system is further configured to estimate lumen output fractions associated with the LED light sources based on junction temperature of the LED light sources and chromaticity coordinates of the desired light to be generated at the light mixing circuit. The light mixing circuit further comprises a temperature sensor for measuring the temperature associated with the LED light sources and a light detector for measuring lumen output level of light generated by the LED light sources. Based on the temperatures measured, the controller system determines the amount of output lumen that each of the LED light sources need to generate in order to achieve the desired mixed light output, and the light detector in conjunction with a feedback loop maintains the required lumen output for each of the LED light sources.

14 Claims, 5 Drawing Sheets

WHITE LED LUMINARY LIGHT CONTROL SYSTEM

BACKGROUND OF THE INVENTION

This invention relates to LED luminaries and more specifically, to a control system for providing white light with selectable color temperature and dimming level.

BACKGROUND OF THE INVENTION

Within the past few years LED technology has advanced remarkably to a point where the efficiency of light generated by an LED array matches or even exceeds the efficiency of incandescent lamps. In many lighting applications, Red, Green and Blue LED arrays are employed to generate a conventional white light. By properly mixing the lumen generated by each group of the Red, Green and Blue LED it is possible to control the "color temperature" of the white light generated by the LED array. Theoretically, color temperature of a light source is defined as the temperature of a plankian radiator (ideal light source) whose radiation has the same chromaticity as that of the light source, and is measured in Kelvins. To an ordinary observer the color temperature refers to the color of the white light. A cooler white light—similar to the light generated by commercial fluorescent lamps—has a lower temperature, whereas a warmer white light—similar to the light generated by residential incandescent lamps—has a higher temperature.

The term chromaticity is applied to identify the color of the light source regardless of its lighting level or lumen. When the chromaticity of different light sources is equal, the color of the light from each light source appears the same to the eye regardless of the lighting level. The chromaticity of a light source is represented by chromaticity coordinates. An example of such coordinates is the CIE 1931 chromaticity diagram, in which the color of the emitted light is represented by x, and y coordinates.

Practically, the color temperature of an LED array is defined as the correlated color temperature. The term correlated color temperature refers to a light source whose chromaticity coordinates are not exactly equal to any of the chromaticity coordinates of an ideal light source. The correlated color temperature of a real light source, such as a lamp, is thus defined as the temperature of an ideal light source whose perceived color most closely resembles that of the real light source at the same brightness and under specified viewing conditions. In this context, the present description employs the terms color temperature and correlated color temperature interchangeably.

The correlated color temperature and the dimming level of an RGB LED array depend among other things, on the operating temperature of an LED, the age of the LED and batch-to-batch variations in production of the LED.

Thus, there is a need for a control mechanism for white LED luminaries that can maintain a specified light level for all desired operating conditions.

SUMMARY OF THE INVENTION

In accordance with one embodiment of the present invention a white luminary LED is made of three types of LED light sources, using a plurality of Red, Green and Blue LEDs. A light control system is configured to maintain the color temperature and the lumen output level of the emitted white light. The control system comprises a feed-forward temperature compensation arrangement and an optical feedback control system to maintain the target white light. The junction temperature and the light output of the LEDs are sensed and are fed into the light control system.

The temperature feed-forward compensation arrangement is employed to correct the deviation in the target color temperature and the color-rendering index of the white light. A processing means, such as a feed forward temperature compensator means is configured to provide required lumen output fractions of the Red, Green and Blue LED light sources, in response to the junction temperature of the LEDs and the target white light. The required lumen outputs from the Red, Green, and Blue LED light sources for a target white light are calculated by using the chromaticity coordinates of the target white light and the chromaticity coordinates of the light emitted by the LED light sources based on the junction temperature.

In accordance with one embodiment of the invention the chromaticity coordinates for the light emitted by the Red, Green and Blue LED light sources are computed as a function of junction temperature in advance and stored in a memory means. In accordance with another embodiment of the invention the required lumen output fractions of the Red, Green, and Blue LED light sources can also be computed off-line as a function of junction temperature and stored in the memory means.

A lumen output module in combination with a lumen output controller are configured to maintain the light output generated from the LED light sources equal to the light output value provided by the feedforward temperature compensator, regardless of junction temperature, aging and batch-to-batch variation.

DETAILED DESCRIPTION OF THE DRAWINGS

Figure 1:
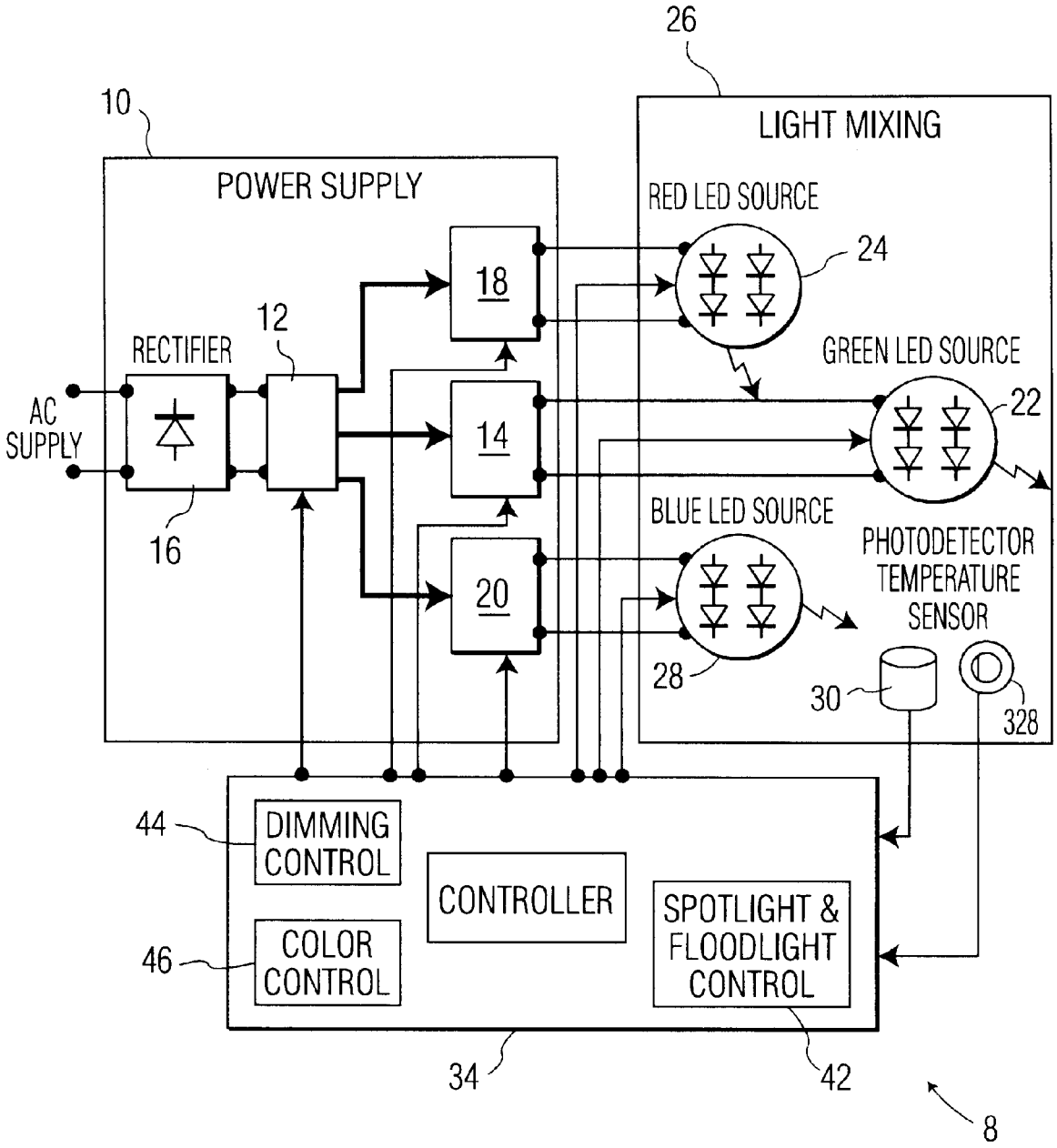
FIG. 1 is a block diagram of a white LED luminary with a control system in accordance with one embodiment of the invention.

FIG. 1 illustrates a block diagram of a white LED luminary 8 having a control system in accordance with one embodiment of the present invention. The luminary includes a power supply 10 that is coupled to light mixer 26 and is configured to provide power to the light mixer. A controller unit is coupled to both power supply 10 and light mixer 26. The controller is configured to provide power factor correction control, lighting level control, color temperature control for white light and variable color control.

Mixer 26 includes a plurality of LED sources such as an array of Red LED light source 24, an array of Green LED light source 22 and an array of Blue LED light source 28. Power supply 10 is configured, to provide regulated power to the Red, Green, and blue LED light sources respectively.

Power supply 10 includes a rectifier 16 that is configured to receive an AC supply current from, for example, a main supply. A DC-to-DC converter 12 is coupled to an output port of rectifier 16. The output ports of DC-to-DC converter 12 is coupled to independent power sources 14, 18 and 20, which provide power to the LED light sources. In accordance with one embodiment of the invention the DC-to-DC converter can be of a fly-back converter type as is well known in the art. In accordance with other embodiments of the invention the DC-to-DC converter can also be of the forward converter or buck types. Furthermore, the converter is configured to also provide power factor correction at the main supply end in conjunction with controller 34. Independent power sources 14, 18 and 20 are configured to function as current sources that supply the required power to the Red, Green and Blue LED light sources.

Light mixer 26 includes mixing optics that combine the light output generated by the Red, Green and Blue LED arrays. Each LED array is controlled by controller 34 to generate the appropriate light output levels for desired color temperature and dimming level.

Light mixer 26 further includes an optical feedback sensor 30 and a temperature feedback sensor 32. Optical feedback sensor 30 obtains the lumen output from the LED light sources and provides that information to controller 34. The optical feedback sensor comprises of a photo-detector such as a photo-diode, and an operational amplifier circuit that is configured to convert the light output level of the LEDs to an electrical signal and amplify the electrical signal generated by the photo-diode. Furthermore, temperature sensor 32 includes sensing means configured to obtain the junction temperature of the LEDs.

Optical feedback sensor 30 is used to measure the light output of the three LED light source arrays. It is desirable to measure the light output directly in lumens. To this end, a photo-diode attached with an appropriate filter to match human eye response is employed to directly measure the lumen output of the LED light sources. In accordance with another embodiment of the invention, a photo-diode without any filters is employed which is used to measure the radiometric output of the LED sources. In this embodiment, however, the optical feedback system is calibrated with suitable means to convert the light output to optometric quantity from the measured radiometric quantity.

As will be explained in more detail below, the light measurement arrangement in accordance with one embodiment of the invention is devised such that one photo-diode is sufficient to measure the output of each LED light source array. Thus, a measurement sequence is employed to measure the light output of the LED light source arrays.

The measurement sequence begins by measuring the light output with all three LED light source arrays in operation. This measurement includes the ambient light in addition to the light outputs from the three LED light sources. Then, one LED light source array is switched "off" briefly, and a measurement is taken. This measurement corresponds to the light output from the other two LED light sources including the ambient light. Thereafter, the difference between the two measurements yields the light output from the LED light source array which is switched "off" The LED light source arrays are switched "off" for a brief period, such that the junction temperature of the LEDs in the light source array does not change significantly. The measurement of the light output is repeated for the other two LED light source arrays. Controller 34 is configured to carry out the measurement sequence periodically as necessary.

Temperature sensor 32 is configured to measure the junction temperature of the LEDs in the light source arrays. In accordance with one embodiment of the invention, temperature sensor 32 includes a thermistor, or a thermopile, or any silicon based sensor that is configured to measure the case temperature of the light mixer 26. In accordance with one embodiment of the invention, only one temperature sensor is employed to measure the case temperature of the LED light source arrays. The junction temperature is then estimated by employing a thermal model of the LED light sources and the electrical current input to the LEDs as will be explained in more detail below.

The junction temperature of the LEDs is estimated so as to determine the required lumen output of the LEDs that provide a desired color temperature. The required lumen output is preferably estimated by employing the chromaticity coordinates of light sources as explained hereinafter. As mentioned before, white light is produced in accordance with one embodiment of the present invention, when the light outputs from Red, Green, and Blue LED light source arrays are mixed in proper combination. Preferably in each array, the plurality of LEDs have substantially similar electrical and optical characteristics. Hence, the white light with a desired or target color temperature is produced by the proper selection of the amount of light output from each LED light source. The required lumen outputs from the Red, Green, and Blue LED light source arrays for a target color can be calculated by employing the chromaticity coordinate of the target white light and the chromaticity coordinates of the light emitted by the LED light sources.

In accordance with one embodiment of the invention, Iw is the total lumen output of the target white light for a desired color temperature and xw, yw are its chromaticity coordinates. The chromaticity coordinates of the Red LED light component for that desired white light is xr, yr. Similarly, the chromaticity coordinates of the Green LED light component for the desired white light is xg, yg. Similarly, the chromaticity coordinates of the Blue LED light component for the desired white light is xb, yb. Furthermore, Ir, Ig, and Ib, are the lumen outputs form the Red, Green and Blue LED light source arrays respectively. The total lumen output of the white light can then be expressed as the summation of lumen outputs of the three LED light source arrays, $$Iw=Ir+Ig+Ib \tag{1}$$

Furthermore, lumen output fractions I'r, I'g, and I'b of the Red, Green and Blue LED light source arrays are defined as, $$I'r=Ir/Iw$$

$$I'g=Ig/Iw$$

$$I'b=Ib/Iw. \tag{2}$$

The chromaticity coordinates of the white light is related to the lumen output fractions and the chromaticity coordinates of the LED light source array as follows, $$\begin{array}{cccc} \frac{x_W}{y_w} & \frac{x_R}{y_R} & \frac{x_G}{y_G} & \frac{x_B}{y_B} \\ \frac{1}{y_w} = & \frac{1}{y_R} & \frac{1}{y_G} & \frac{1}{y_B} \end{array} \times \begin{array}{c} I'_R \\ I'_G \\ I'_B \end{array}$$

$$1 \quad 1 \quad 1 \quad 1$$

In accordance with one embodiment of the invention, the chromaticity coordinates of the LED light sources are estimated by controller 34. Thus, by knowing the desired chromaticity coordinates of the white light and the chromaticity coordinates of the LED light sources, the required lumen output fractions can then be calculated based on equation (3). In one embodiment of the invention, these calculations are done off-line, based on a predetermined set of desired white light coordinates and corresponding LED light source coordinates. It is noted that for a given chromaticity coordinates corresponding to a desired white light, the lumen output fractions are always positive and unique.

As will be explained in more detail below, the chromaticity coordinates of the white light are obtained from the desired color temperature of the white light. Thus, in accordance with one embodiment of the invention, controller 34 is configured to store a plurality of white light chromaticity coordinates that correspond to a plurality of desired color temperatures which are selectable by the user.

Furthermore, the chromaticity coordinates of the LED light sources is estimated based on the junction temperature as measured by controller 34. This follows because the characteristics of LED light sources vary with the temperature. The lumen output of the LED light sources varies exponentially and the peak wavelength varies linearly with the variation in junction temperature. When the peak wavelength of the light emitted by the LED varies, the chromaticity coordinates of the LED light sources also vary. Thereby the chromaticity coordinates of the mixed light obtained from the LED luminary is different from the target white light or the desired color light when the junction temperature of the LED changes. Thus, the target color temperature for white light can not be maintained with the variation in junction temperature without controller 34.

In accordance with one embodiment of the present invention, based on the desired white light chromaticity coordinates and the LED light source chromaticity coordinates, controller 34 derives the required output lumen fractions and adjusts its feedback control system to maintain the output lumen of the LED light sources so as to generate the amount of light that is substantially equal to the calculated output lumen fractions.

Figure 2:
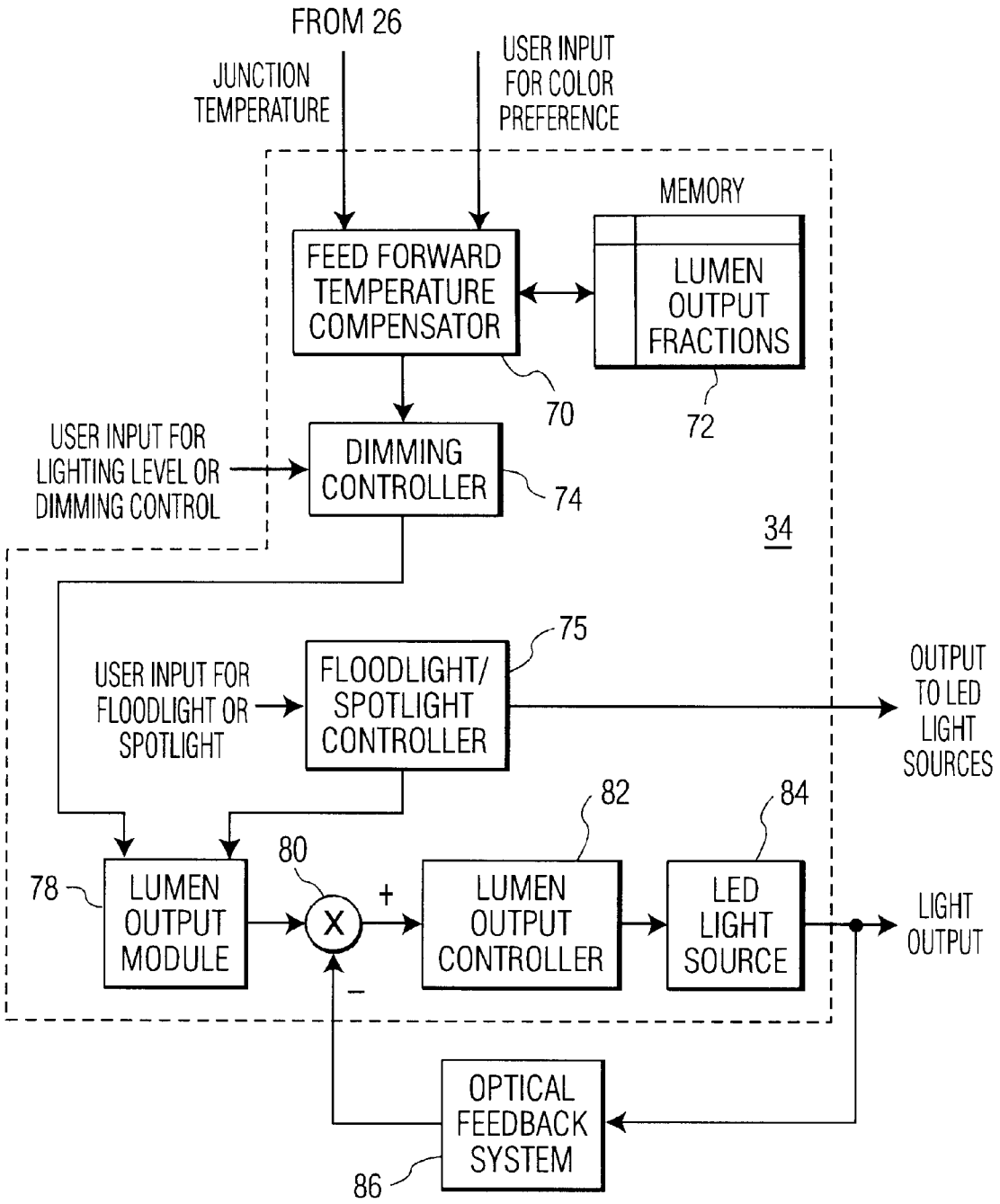
FIG. 2 is a block diagram of various components of the control system illustrated in FIG. 1, in accordance with one embodiment of the invention.

FIG. 2 illustrates various components of controller 34 in accordance with one embodiment of the present invention. To this end controller 34 includes a feed forward temperature compensator 70, which is configured to receive. (1) LED junction temperature from temperature sensor 30, and; (2) user input for the luminary color preference or color temperature of the white light. Feed forward temperature compensator 70 is configured to provide lumen output fractions of LED light sources.

A lumen output fraction memory is coupled to feedforward temperature compensator 70. This memory stores lumen output fractions that have been previously calculated in accordance with one embodiment of the invention as explained hereinafter.

The chromaticity coordinates for a white light with a specifiable target color temperature or for a light with the desired color, is known. The required lumen output fractions of the Red, Green and Blue LED light sources are computed off-line as a function of the junction temperature.

In order to obtain the required lumen output fractions as a function of junction temperature, the chromaticity coordinates for the light emitted by the Red, Blue and Green light sources are computed as a function of junction temperature based on the data given by the LED manufacturer. Next, for all desired while light chromaticity coordinates the required lumen output fractions of the Red, Green and Blue light sources are computed off-line as a function of junction temperature. As a result, lumen output fraction memory 72 is configured to store the computed lumen output fractions as a function of junction temperature. Feedforward temperature compensator is configured to retrieve the stored lumen output fractions based on the junction temperature and the desired color of the output light. It is noted that although the output light is referred as the desired white light, other desired colors can also be generated by providing the corresponding chromaticity coordinates for those desired colors.

Controller 34 further includes a dimming controller 74 coupled to feedforward temperature compensator 70, and is configured to receive user input for lighting level or the dimming control of the mixed light generated by the LED light source arrays. Thus, the lumen outputs that need to be produced by the LED light sources are then obtained by multiplying the total lumen output of the target light with the lumen output fractions. Dimming controller 74 is coupled to a lumen output module 76, which is configured to maintain the desired lumen output values of the LED light sources as employed by controller 34 in its optical feedback system arrangement.

Controller 34 further includes a floodlight/spotlight controller 75, which is configured to receive user input for a desired floodlight or spotlight illumination. Controller 75 is configured to determine which LEDs in each of the LED light source arrays are required to be enabled in order to achieve the desired illumination. One output port of controller 75 is configured to provide control instructions to the LEDs in each of the LED light source arrays. Furthermore, in accordance with another embodiment of the invention, another output port of controller 75 is configured to provide lumen output instructions to lumen output module 78.

Lumen output module 78 is configured to store lumen output requirements for each of the LED light sources in each of the light source arrays. Therefore, controller 34 employs an arrangement wherein desired white color temperature or desired color rendering or desired floodlight or spotlight illumination can be achieved.

Lumen output module 78 is coupled to an input port of an adder 80, as part of an optical feedback control arrangement employed by controller 34. The output port of the adder is coupled to a lumen output controller 82, which is configured to generate an appropriate current signal that is fed to LED light source array 84.

Optical feedback system 86 is configured to obtain the output lumen of the LED light sources by employing optical feedback sensor 30 and convert the received light signal to a corresponding electric signal. An output port of optical feedback system 86 is coupled to the second input port of adder 80 in a feedback loop arrangement.

The junction temperature of the LED light sources is calculated in accordance with various embodiments of the present invention. However, the invention is not limited in scope to a particular embodiment discussed herein and other means for measuring the junction temperature of the LED light sources can be employed. Thus, in accordance with one embodiment of the invention, one way to measure the junction temperature is to use the forward voltage drop across the LED. The forward voltage drop across an LED varies linearly with the temperature. The forward drop across a string of LEDs in a light source array can thus be measured and the variation in forward voltage drop can be employed to determine the average junction temperature of the LEDs. In some instances, the variation in forward voltage across the LED light sources may be small. Thus, this embodiment is advantageously employed for circumstances wherein a large number of LEDs are connected in series such that the forward voltage drop across the LEDs is large enough for accurate measurement of the junction temperature.

In accordance with another embodiment of the invention, the junction temperature of the LED can also be obtained by using the measurements taken from the optical feed back system and the temperature sensor. At the beginning, when the luminary is not working, the junction temperature of the LED is the same as the case temperature, which can be measured at the start up. As a part of the start up process, the output of the LED light sources is also measured for a test condition. For the test condition, a test current is supplied to the LED light sources. The LED light sources are turned "on" briefly such that the junction temperature is nearly constant. The output of detector 30 is denoted as $I_{V1}$, for a test current $I_{f1}$ and the case temperature $T_1$. It is well known that the light output of the LED is proportional to the forward current and it varies exponentially with temperature. Thus, the output of the photo-detector can be expressed by, $$I_{V2}(T_2)=k_{V1}\cdot I_{f2}\cdot e^{-((T_2)-T_n)}/T_0 \quad (4)$$

Where, $k_{V1}$ is the gain constant between the forward current to the photo-detector output, $T_n$ is nominal temperature and $T_O$ is a constant supplied by the manufacturer, and is defined as the intensity temperature coefficient for the LED, which describes how the lumen output of the LED varies with the temperature. When the white LED luminary is turned "on" and is working, the junction temperature of the LED increases slowly. With the increase in junction temperature, the lumen output of the LED decreases. Now a measurement for the lumen output of the LED can be taken based on the operating current $I_{f2}$. The output $I_{V2}(T_2)$ of the photo-detector corresponding to the junction temperature $T_2$ is obtained by, $$I_{v1}(T_1)=k_{v1}\cdot I_{f1}\cdot e^{-(T_1-T_n)}/T_0 \quad (5)$$

Then, the following expression can be obtained:

$$\frac{I_{v2}(T_2)}{I_{vl}(T_1)} = \frac{I_{f2}}{I_{fl}} e^{-(T_1-T_2)_{25}/T_0} \quad (6)$$

Equation (6) is solved for $T_2$. The test current In is advantageously, the current at start up, which can be a predetermined value. Current $I_{f1}$ is preferably the operating current at temperature $T_2$, and the measurement can be made without sending any test current. Solving for $T_2$-$T_1$, involves the exponential constant. Therefore, the solution for the exponential constants can be computed off-line and stored in memory array/lookup table. Therefore, it is possible to obtain $T_2$-$T_2$, by retrieving the previously stored results corresponding to the exponential component. The lookup table can be periodically updated to reflect the aging of the LEDs. The variation in junction temperature can be obtained from the above expression. In accordance with another embodiment of the invention, a simple approximation can be used to solve the above equation.

The determination of junction temperature in accordance with the embodiment mentioned above has significant advantages. For example, it overcomes the changes in the characteristics of the LED due to aging.

Controller 34 takes the output of optical feedback system 86 (FIG. 2), and the junction temperature sensor 32 (FIG. 1) as the inputs. Thus, the controller controls the output of the supply to maintain the target light with the desired color temperature for white light or the desired color of the light. Since, the power supply is made up of high frequency PWM converters, the output of the controller to the power supply represents either the duty-ratio or the ON-time for PWM pulses.

In accordance with various embodiments of the invention, the functions of the controller is implemented by means of analog and or digital circuitry. However, the digital implementation is preferable for purposes of the present invention. For example, controller 34 with a digital arrangement employs low cost microcontroller and digital signal processors (DSP).

Figure 3:
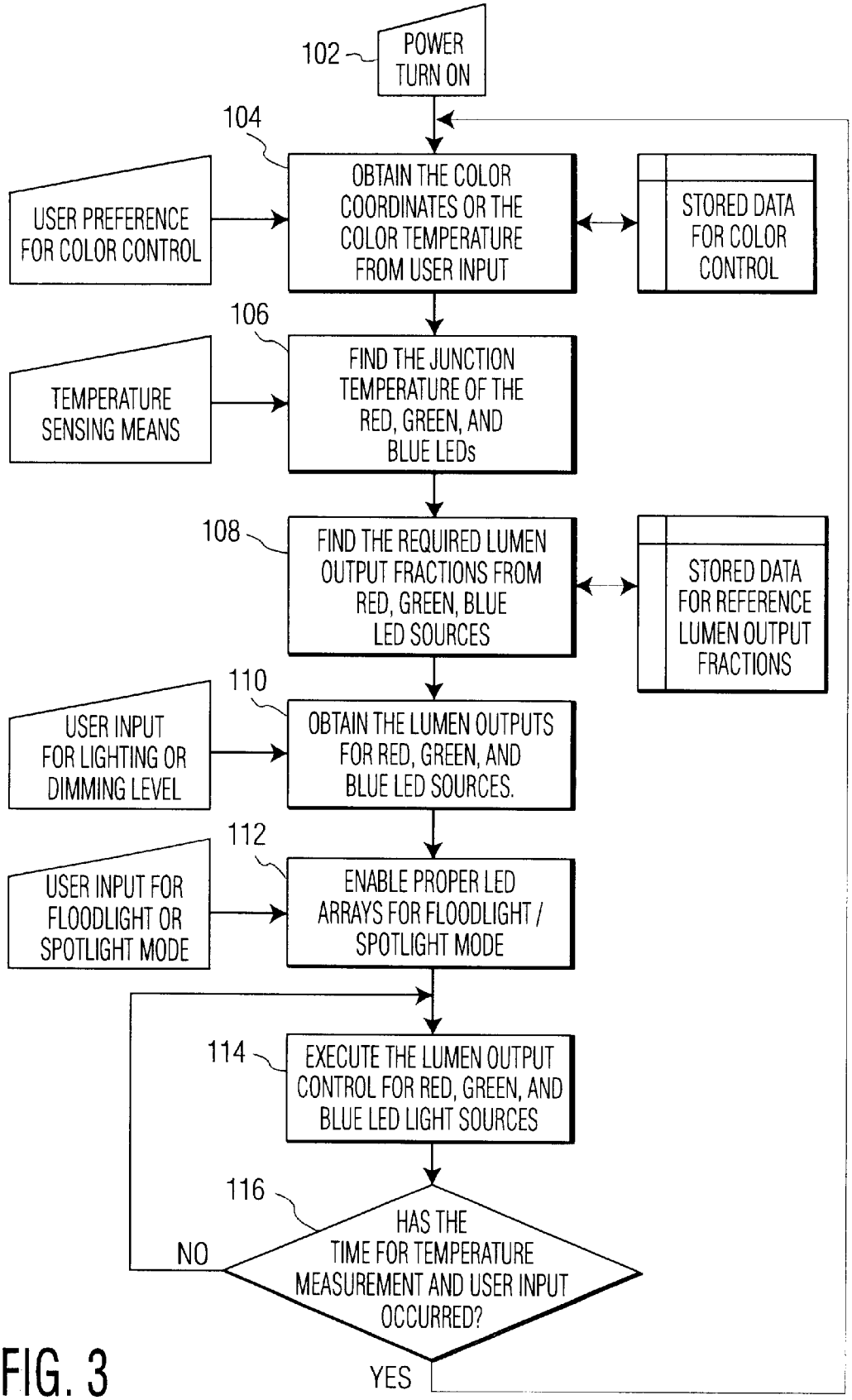
FIG. 3 is a flow chart illustrating the control process employed by the control system in accordance with one embodiment of the present invention.

FIG. 3 is a flow chart illustrating the operation of controller 34 in accordance with one embodiment of the invention. When the lamp power is turned "on" at step 102, the user preference for color temperature of the white light or the desired color of the light is provided at step 104. Furthermore, at step 104, controller 34 in response to user color preferences, retrieves the corresponding chromaticity components of the desired temperature and color for the white light as requested by the user.

At step 106, controller 34 senses the junction temperature of the LED light source arrays by employing temperature sensor 32 as described above in reference with FIG. 1. At step 108, the controller retrieves the required lumen output fractions, which are stored off-line in advance of the operation of the luminary. As explained before, the chromaticity of LED light sources as a function of temperature is stored in controller 34 , along with the calculated lumen output fractions. Thus, depending on the junction temperature and the color of the light, the required lumen output fractions of the LED light sources are read out from the memory arrays of controller 34.

At step 110, controller 34 receives the user input for the lighting level or the level of dimming. In response, the required lumen outputs of the LED light sources are estimated by multiplying the lumen output fractions with the total lumen output of the white light. The calculated lumen outputs for the LED light source arrays define the reference value for the lumen output control system.

At step 112, controller 34 also senses the user preference for floodlight or spotlight mode of operation and enables the proper LED light sources in each light source array to produce the floodlight or spotlight beam.

Once the reference lumen outputs of the LED light sources are obtained, the controller executes lumen output control for Red, Green and Blue LED light sources at step 114. The lumen output control system controls the power sources such that the light output from an LED light source is equal to the reference lumen output. Controller 34 continues the lumen output control operation, until such time that decision step 116 determines that the time for temperature measurement and user input has occurred. As a result controller 34 goes back to step 104.

Figure 4:
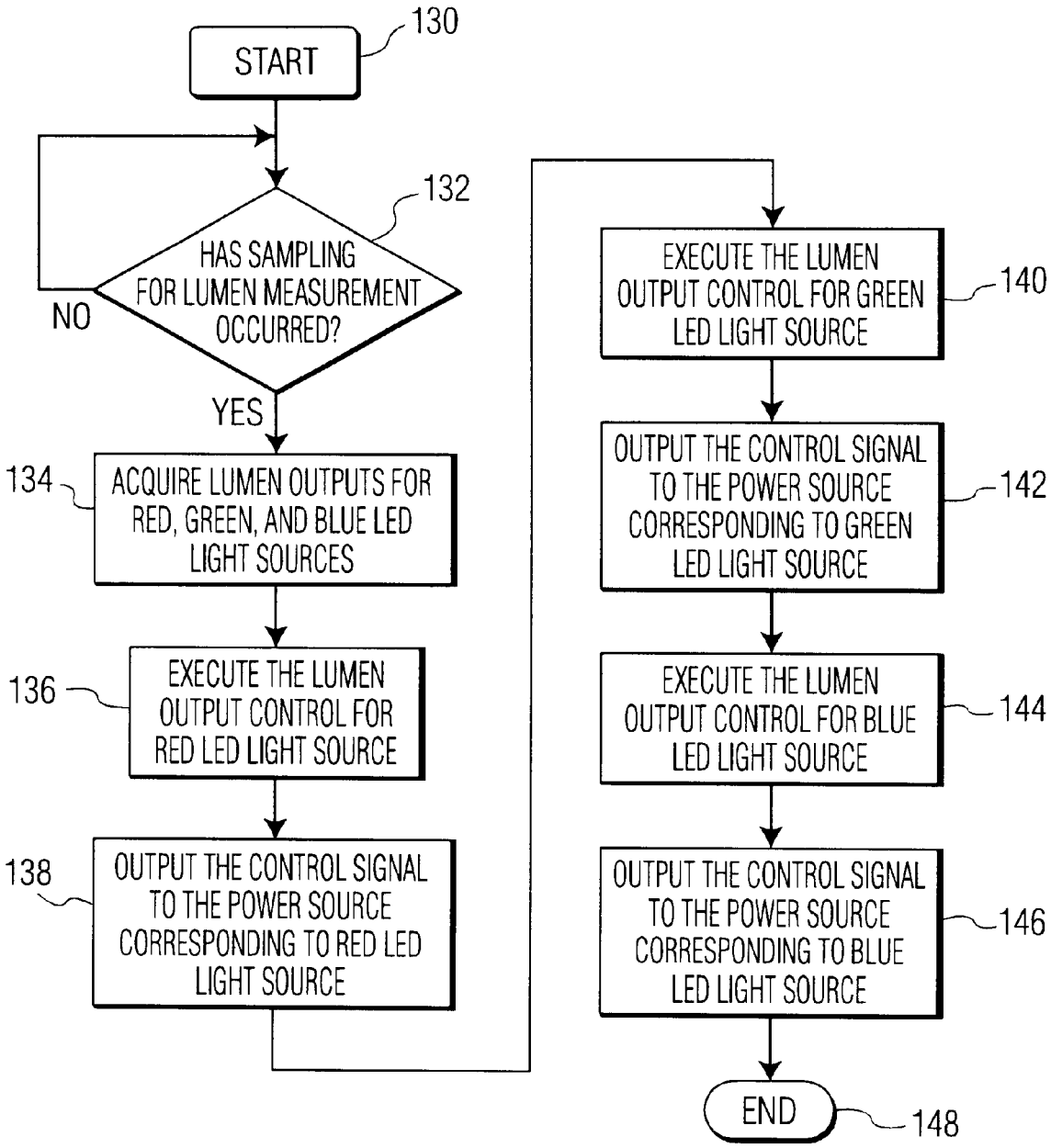
FIG. 4 is a flow chart illustrating the lumen output control process employed by the control system in accordance with one embodiment of the invention.

FIG. 4 is a flow chart that illustrates the lumen output control for the Red, Green, and Blue LED light sources. At step 132 controller 34 waits for the sampling time to occur so that the lumen outputs from the LED light sources can be obtained as illustrated and described later in reference with FIG. 5.

At step 134 controller 34 acquires lumen outputs for Red, Green and Blue LED light sources. At step 136 controller 34 executes the lumen output control for Red LED light source. At step 138, controller 34 provides an appropriate control signal to power source 18 (FIG. 1) corresponding to Red LED light source array. Similarly, at step 140 controller 34 executes the lumen output control for the Green LED light source. At step 142, controller 34 provides an appropriate control signal to power source 14 (FIG. 1) corresponding to Green LED light source array. Similarly, at step 144 controller 34 executes the lumen output control for the Blue LED light source. At step 146, controller 34 provides an appropriate control signal to power source 20 (FIG. 1) corresponding to Blue LED light source array.

Figure 5:
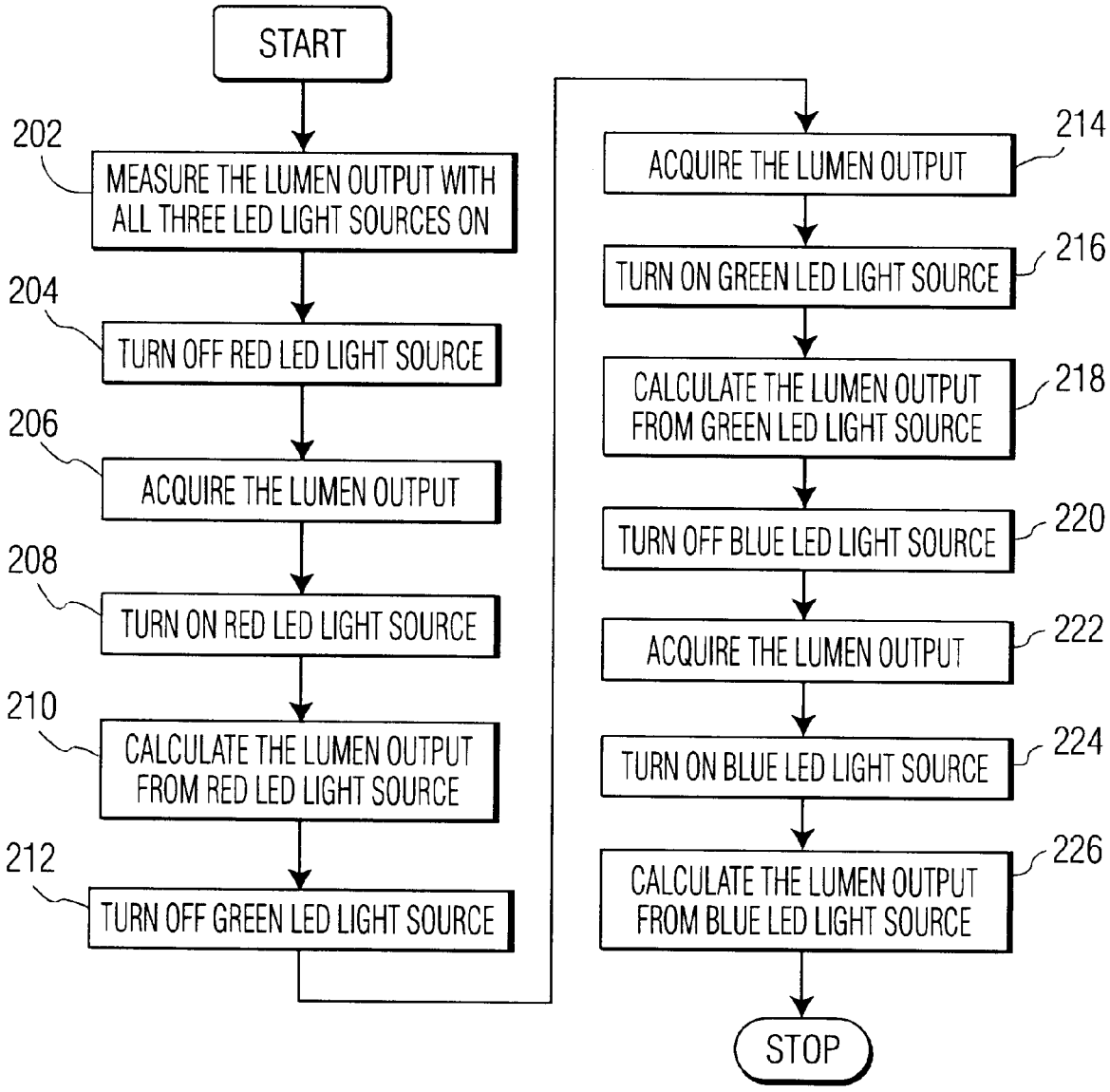
FIG. 5 is a flow chart illustrating the process for measuring lumen output using a single photo-detector in accordance with one embodiment of the present invention.

FIG. 5 is a flow chart illustrating the measurement sequence for measuring the lumen output of each of the LED light source arrays. At step 202 lumen output is measured when the luminary begins to operate with all the LED light sources "on." which also includes the component of ambient light. At step 204, the LED light source array intended to be measured, for example, Red, LED light source array is switched "off" briefly and a measurement is taken at step 206. At step 208 the Red LED light source array is turned "on" again, and at step 210, the difference between the two measurements yields the lumen output for the Red LED light source array.

Similarly, at step 212, the Green LED light source array is switched "off" briefly and a measurement is taken at step 214. At step 216 the Green LED light source array is turned "on" again, and at step 218 the difference between the two measurements is calculated so as to yield the lumen output for the Green LED light source array.

Similarly, at step 220, the Blue LED light source array is switched "off" briefly and a measurement is taken at step 222. At step 224 the Blue LED light source array is turned "on" again, and at step 226 the difference between the two measurements is calculated so as to yield the lumen output for the Blue LED light source array.

The measurement sequence described in connection with FIG. 5 in accordance with one embodiment of the invention, also overcomes the problem with the ambient light. The measurement is carried out for all the three LED light source arrays and the lumen outputs of the LED light sources are obtained. Then the lumen output control for the LED light sources are executed in sequence for Red, Green and Blue LED light source arrays.

Thus, in accordance with various embodiments of the invention, a white luminary control system is employed, which is capable of accurately and efficiently maintaining a desired level of white color temperature and lumen output.

We claim:

1. An LED luminary system for providing power to LED light sources to generate a desired light color, said LED luminary system comprising:

a power supply stage configured to provide a DC current signal;

a light mixing circuit coupled to said power supply stage, said light mixing circuit having a plurality of LED light sources configured to receive said DC current signal; and a controller system coupled to said power supply stage configured to provide control signals to said power supply stage so as to maintain said DC current signal at a desired level, said controller system further configured to respond to a temperature associated with said LED light sources and to estimate lumen output fractions associated with said LED light sources based on junction temperature of said LED light sources and chromaticity coordinates of said desired light color to be generated at said light mixing circuit.

2. The LED luminary system according to claim 1 wherein said light mixing circuit further comprises a plurality of red, green and blue LED light sources.

3. The LED luminary system according to claim 2, wherein said light mixing circuit further comprises a temperature sensor for measuring the temperature associated with said LED light sources and a light detector for measuring lumen output level of light generated by said LED light sources.

4. The LED luminary system according to claim 3 wherein said controller further comprises a memory table configured to store said lumen output fractions as a function of junction temperature of said LED light sources and chromaticity coordinates of said desired light color.

5. The LED luminary system according to claim 4, wherein said junction temperature of said LED light sources is measured based on forward voltage drop of said LED light source.

6. The LED luminary system according to claim 4, wherein said junction temperature of said LED light sources is measured based on current signal provided to said LED light sources, and lumen output level corresponding to said current signal.

7. The LED luminary system according to claim 6 wherein said junction temperature is measured by solving $$\frac{I_{v2}(T_2)}{I_{v1}(T_1)} = \frac{I_{f2}}{I_{f1}} e^{-(T_1-T_2)/T_0}$$

wherein $I_v$ is lumen output of said LED light source at a specified temperature and $I_f$ is current signal provided to said LED light source corresponding to said specified temperature.

8. In an LED luminary system a method for providing power to LED light sources to generate a desired light color, said method comprising the steps of:

generating a plurality of DC current signals;

providing said signals to a plurality of LED light sources to effect production of a desired light; and responding to a temperature associated with said LED light sources and estimating lumen output fractions associated with said LED light sources based on junction temperature of said LED light sources and chromaticity coordinates of said desired light color to be generated by said plurality of LED light sources.

9. The method according to claim 8 wherein said step of estimating lumen output fractions further comprises the steps of:

estimating chromaticity coordinates of said LED light sources as a function of junction temperature of said LED light sources;

generating a plurality of lumen output fractions as a function of said junction temperature and chromaticity coordinates of a plurality of said desired light color levels; and storing said lumen output fractions as a function of said junction temperature.

10. The method according claim 9 further comprising the step of providing a feedback control for maintaining said desired light color based on lumen levels of said LED light sources associated with said output lumen fractions.

11. The method according to claim 10 further comprises the step of measuring the temperature associated with said LED light sources and measuring lumen output level of light generated by said LED light sources.

12. The method according to claim 11 further comprising the step of estimating said junction temperature of said LED light sources based on forward voltage drop of said LED light source.

13. The method according to claim 11, further comprising the step of estimating said junction temperature of said LED light sources based on current signal provided to said LED light sources, and lumen output level corresponding to said current signal.

14. The method according to claim 13 wherein said step of estimating further comprises the step of solving $$\frac{I_{v2}(T_2)}{I_{vl}(T_1)} = \frac{I_{f2}}{I_{fl}} e^{-(T_1-T_2)/T_0}$$

wherein $I_v$ is lumen output of said LED light source at a specified temperature and $I_f$ is current signal provided to said LED light source corresponding to said specified temperature.

* * * * *